US006119733A

United States Patent [19]

Arndt et al.

[11] Patent Number: 6,119,733

[45] Date of Patent: Sep. 19, 2000

[54] CONTROLLABLE WEFT THREAD PRESENTING AND CLAMPING APPARATUS INCLUDING AN ACTUATED CLAMP ELEMENT

[75] Inventors: Stephan Arndt; Horst Haeussler; Kurt Motz; Peter Schiller, all of Lindau, Germany

[73] Assignee: Lindauer Dornier Gesellschaft mbH, Lindau, Germany

[21] Appl. No.: 09/441,098

[22] Filed: Nov. 16, 1999

[30] Foreign Application Priority Data

Nov. 16, 1998 [DE] Germany ..... 198 52 794

[51] Int. Cl.[7] ..... D03D 47/34

[52] U.S. Cl. ..... 139/453; 139/194; 139/216; 242/149; 242/419.4

[58] Field of Search ..... 139/194, 453, 139/447, 216, 217; 242/419.3, 419.4, 149; 66/158; 188/65.1

[56] References Cited

U.S. PATENT DOCUMENTS

| | | | |
|---|---|---|---|
| 4,175,307 | 11/1979 | Altenweger | 28/211 |
| 4,429,842 | 2/1984 | Kiipper | 242/149 |
| 4,641,688 | 2/1987 | Gehring . | |
| 4,655,263 | 4/1987 | Dornier et al. . | |
| 4,817,681 | 4/1989 | Krumm et al. . | |
| 4,834,147 | 5/1989 | Eberle et al. . | |
| 5,305,966 | 4/1994 | Motta | 242/149 |
| 5,398,731 | 3/1995 | Schuster . | |
| 5,476,122 | 12/1995 | Schuster et al. . | |
| 5,483,997 | 1/1996 | Corain et al. | 139/194 |
| 5,669,424 | 9/1997 | Schiller et al. . | |
| 5,901,896 | 5/1999 | Gal | 228/4.5 |

FOREIGN PATENT DOCUMENTS

| | | |
|---|---|---|
| 0634509 | 1/1995 | European Pat. Off. . |
| 297 16 310 | 5/1998 | European Pat. Off. . |
| 4306911 | 12/1993 | Germany . |
| 298 08 997 U | 9/1998 | Germany . |

*Primary Examiner*—Andy Falik
*Attorney, Agent, or Firm*—W. F. Fasse; W. G. Fasse

[57] ABSTRACT

A weft thread clamp for a weft thread presenting lever is positively actuated to selectively open or close the clamp and thereby release or hold the weft thread respectively. To achieve this, a second clamp element is movable or deflectable relative to a first clamp element of the clamp. The movable second clamp element may be directly embodied as an actuator, or may be driven by an actuating motion provided by an actuator located remotely from the clamp on the lever. In the latter case, a motion transmission arrangement such as a sheathed push-pull cable or a rod linkage operatively connects the actuator to the movable second clamp element. The actuator may be a piezoelectric, electromagnetic, hybrid pneumatic-electric, or hybrid hydraulic-electric device, or an electric motor. The loom control unit is connected to the actuator for providing control signals thereto.

18 Claims, 5 Drawing Sheets

5
5A 1B
2
1
1A"

13
2C
2D
6
14
1B
1D
13
14
1A

1A'
1A
2C
4C
4A
6

CONTROLLABLE WEFT THREAD PRESENTING AND CLAMPING APPARATUS INCLUDING AN ACTUATED CLAMP ELEMENT

PRIORITY CLAIM

This application is based on and claims the priority under 35 U.S.C. §119 of German Patent Application 198 52 794.2, filed on Nov. 16, 1998.

FIELD OF THE INVENTION

The invention relates to a controllable weft thread presenting and clamping apparatus including plural weft presenting levers that each respectively have a thread clamp which clampingly holds a weft thread that is to be inserted into the weaving shed of a weaving loom. The invention further relates to a thread clamp having two clamp elements.

BACKGROUND INFORMATION

The weft thread presenting and clamping apparatus includes several presenting levers. A weft thread clamp is mounted on the free end of each of the levers. Each lever can be moved by suitable means into a reference plane established for feeding or presenting a weft thread to a weft thread insertion device and can be swung or pivoted in the reference plane about a pivot axis, from a home position into at least one operating position, for example, into a so-called presenting position for presenting a weft thread to the gripper of a gripper loom. The particular weft thread to be presented to the weft thread insertion device is clamped between a first and a second clamp element in a corresponding weft thread clamp of the respective presenting lever.

The clamping and releasing functions of the clamp elements of the weft thread clamp are carried out passively under the constant elastic clamping tension of the clamp elements, as follows. The respective weft thread clamp automatically or necessarily takes up and holds the weft thread that has been inserted into the weaving shed, as this thread is beat-up against the binding edge, when the respective associated presenting lever is in an intermediate position between the home position and the operating position. Thereby, the constant elastic clamping tension of the clamp elements relative to each other holds the weft thread clamped therebetween. Disadvantageously, however, this process does not ensure that the weft thread has been clamped reliably and that the clamping can also be maintained independently of the point of time of the presenting of the weft thread. Also, the time at which the thread is to be released is not precisely definable.

The following example illustrates the above described disadvantages. A weft thread presenting and clamping apparatus according to the German Utility Model DE 297 16 310 U1, or according to allowed U.S. application Ser. No. 09/150,355 respectively, has a pluraity of weft thread presenting levers, e.g., six levers. A particular weft thread that is clampingly held in a respective thread clamp is to be presented to the weft insertion gripper only during some of the weft insertion operations, and not during others, for example when a different color thread held by a different one of the clamps is to be inserted. As a result, the respective presenting lever is moved up and down a number of times into different vertical positions relative to the reference plane, while holding the clamped weft thread. These movements of the presenting lever can result in the weft thread being unintentionally pulled from the clamp and, consequently, can lead to an interruption of the weaving process.

A further disadvantage of the known thread clamps is that the weft thread, when being picked up by the gripper, must be pulled out of the clamp, which still applies the constant clamping tension to the thread. This process can damage the structure of the weft thread and lead to unravelling of the thread end, resulting in single filaments of the thread remaining in the clamp, or in breakage of the weft thread.

OBJECTS OF THE INVENTION

In view of the above it is an object of the invention to provide a weft thread clamp for a weft thread presenting and clamping apparatus of the above mentioned general type, wherein the weft thread clamp will enable a positive defined clamping and releasing of the weft thread, appropriately during the operating cycle. The invention further aims to avoid or overcome the disadvantages of the prior art, and to achieve additional advantages, as apparent from the present specification.

SUMMARY OF THE INVENTION

The above objects have been achieved by a controllable weft thread presenting and clamping apparatus having at least one thread clamp including two clamp elements arranged on a respective weft thread presenting lever, wherein at least one of the clamp elements can be positively actuated and thereby moved relative to the other one of the clamp elements, according to the invention. In one embodiment, the actuatable clamp element is itself an actuator such as a piezoelectric element. Another embodiment includes an actuator that is separate and distinct from the two clamp elements, yet operatively connected to the actuatable clamp element for actuating the same. Preferably, in the second embodiment, the actuator is mounted on the respective presenting lever that carries the associated clamp, and is connected to at least one of the clamp elements by a motion transfer member such as a rod linkage or a sheathed push-pull cable. The movable clamp element is movable about a hinge journal or the like, or is flexibly bendable.

The actuator may be driven or controlled by piezoelectric, permanent magnetic, electro-magnetic, pneumatic, pneumatic-electric, hydraulic-electric means, or by an electric motor. Generally, any conventionally known arrangement or device that generates a controlled displacement motion can be used as the actuator. The actuator is controlled by signals from a programmable memory and control unit, hereafter referred to as a control unit, and can be wired directly to the control unit or can receive power and signals by non-contact means, such as by induction.

The weft thread presenting and clamping apparatus of the present invention may have several weft thread presenting levers that can be controllably moved into a reference plane, for example as disclosed in DE 297 16 310 U1. According to the invention, the free end of the respective presenting lever may be provided with or may itself form a fixed first clamp element, and a controllably actuatable or movable second clamp element is secured to the presenting lever so as to be movable relative to and to clampingly cooperate with the first clamp element for controllably clamping and releasing the weft thread therebetween.

In the first embodiment, the second clamp element comprises the actuator as a part or the entirety thereof, whereby the actuator may be termed an incorporated actuator while in the second embodiment the second clamp element is a movable clamp element that is operatively connected, by a motion transfer member, to an actuator arranged on another portion of the presenting lever whereby the actuator may be termed a remote actuator. In either embodiment, the actuator is connected to the control unit of the loom for signal transmission therebetween. In this manner, the opening and closing, or releasing and clamping, of each respective clamp is actuated in a controlled manner in synchronism with the weft insertion and beat-up operations carried out by the loom, under control of the control unit.

In a further feature of the apparatus according to the present invention, the swing or pivot motions of the individual weft thread presenting levers in the reference plane are also freely programmable within a range of angular rotation, whereby the overall range of angular rotation is less than 90°. The programmed control in this context is carried out by the control unit.

BRIEF DESCRIPTION OF THE DRAWINGS

In order that the invention may be clearly understood it will now be described in connection with example embodiments, with reference to the accompanying drawings, wherein.

DETAILED DESCRIPTION OF PREFERRED EXAMPLE EMBODIMENTS AND OF THE BEST MODE OF THE INVENTION

Figure 2:
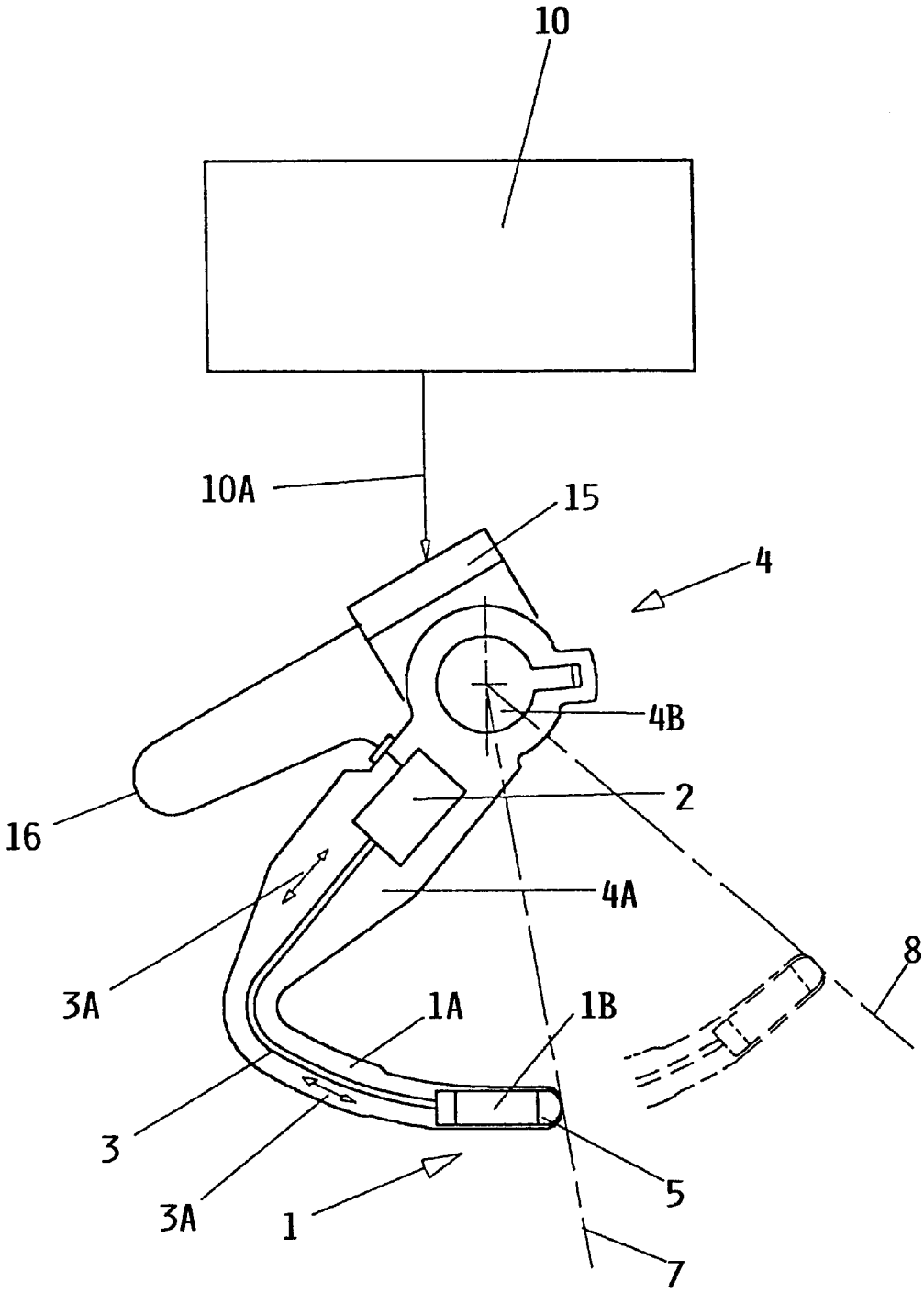
FIG. 2 is a schematic plan view of a weft thread presenting and clamping apparatus with an actuator located remotely from the weft thread clamp, wherein the actuator is hardwired to the control unit for signal and/or power transmission.

FIG. 2 shows an overall weft thread presenting and clamping apparatus 4 of the present invention, especially according to a second embodiment thereof (which will be particularly described below). The overall structure and operation of the apparatus 4 may be as disclosed in U.S. Pat. No. 6,026,865 (Krumm et al.), the entire disclosure of which is incorporated herein by reference. Alternatively, the overall apparatus 4 may have any conventionally structure and function, while the present inventive features especially relate to the weft thread clamp arrangement.

Figures 1, 1A, 1B, 1C:
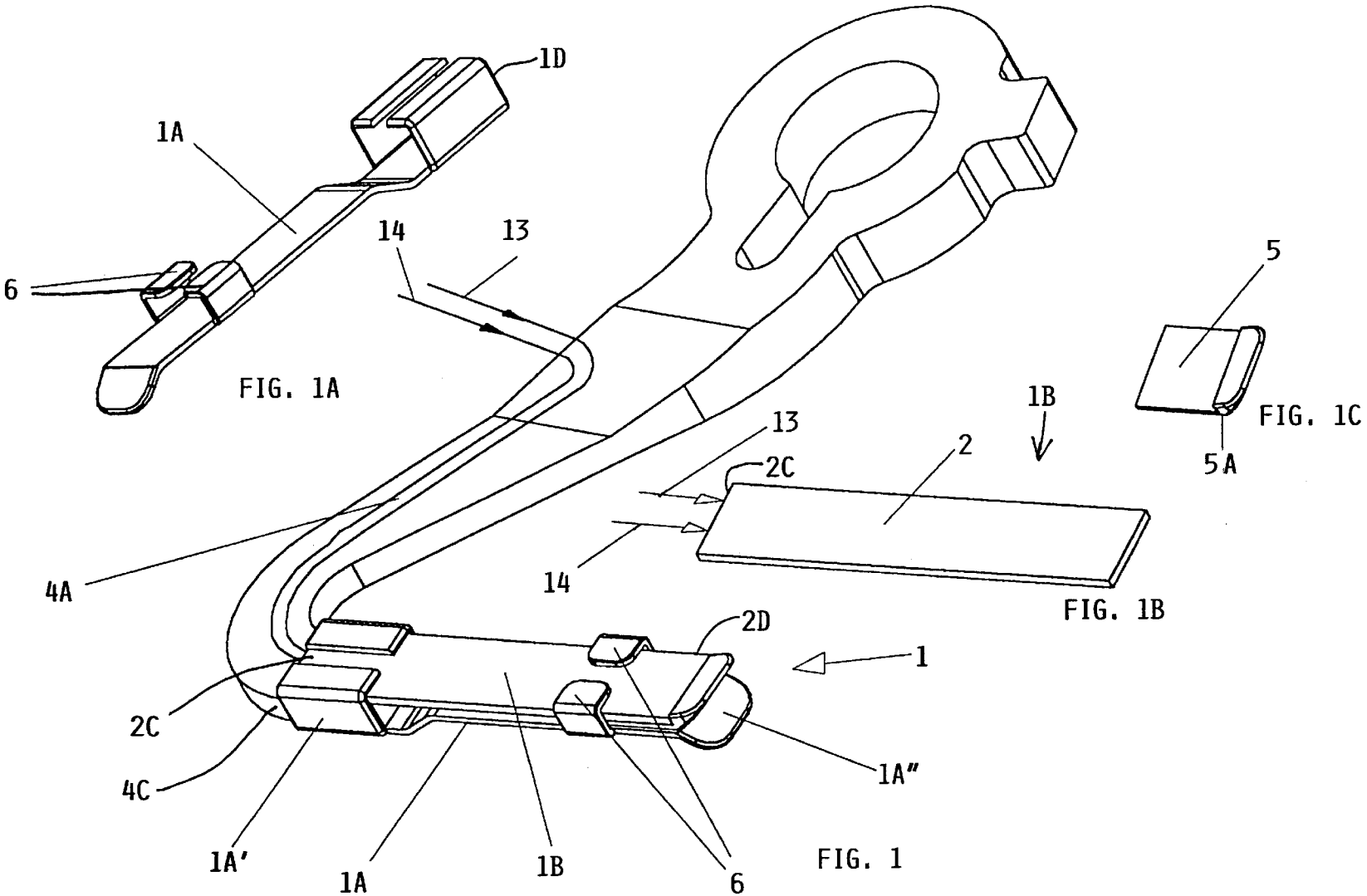
FIG. 1 is a perspective view of a complete weft thread presenting lever with a thread clamp including an actuator that directly forms a clamp element.
FIG. 1A is a perspective view of a rigid first clamp element of the weft thread clamp shown in FIG. 1.
FIG. 1B is a perspective view of the piezoelectric actuator forming the second clamp element of the weft thread clamp of FIG. 1.
FIG. 1C is a perspective view of a wear-resistant clamp tip body that can be attached to the piezoelectric actuator.

FIGS. 1 through 1C show an individual or isolated weft thread presenting lever 4A of the apparatus 4, and its individual components. As shown in FIG. 1, a thread clamp 1 is fixedly attached by any known means to a free end 4C of the weft thread presenting lever 4A. In the present first embodiment, the thread clamp 1 includes a rigid first clamp element 1A and a deflectable second clamp element 1B comprising a piezoelectric actuator 2. A first end 1D of the first clamp element 1A has a C-shaped profile section 1A' that fits around and secures the first clamp element 1A to the free end 4C of the lever 4A, while simultaneously securely holding a first terminal end area 2C of the second clamp element 1B, and thereby connecting the second clamp element 1B with the free end 4C of the lever 4A. The first terminal end area 2C can additionally be potted or sealed with a suitable material or secured with an adhesive.

As shown in FIGS. 1 and 1C, a second terminal end area 2D of the second clamp element 1B may be outfitted with or carry a wear-resistant weft thread clamp tip body 5 having a thread take-up surface 5A that is sloped relative to the plane of the major extension of the clamp tip body 5. A second end, i.e. the free end, of the rigid clamp element 1A also has a thread take-up surface 1A" that is sloped relative to the plane of the major extension of the clamp element 1A, as shown in FIGS. 1 and 1A. The rigid clamp element 1A also has a stop 6 extending therefrom, that limits the opening motion of the actuator 2.

In this preferred embodiment, the piezoelectrically operated thread clamp 1 is driven by signals transmitted via wires 13, 14 from the control unit 10 of the loom, as shown in FIG. 2. More particularly, the wires 13 and 14 are connected to the first terminal end area 2C of the piezoelectric actuator 2 to apply an electric actuating voltage to the actuator 2. The actuator 2 may comprise a single piezoelectric element including a plate of a piezoelectric material and electrodes provided thereon, or a stack of plural such piezoelectric elements. Any known piezoelectric material in any known actuator arrangement may be used. A piezoelectric actuator is preferred for its compact size, positive and precise actuation, simple control means, and very good reliability as an integral solid state component.

When the control unit 10 provides an actuating voltage via the wires 13, 14 to the actuator 2, the actuator flexes or deflects responsively to the applied signal. Thereby the clamp element 1B moves relative to the clamp element 1A, and particularly the clamp tip body 5 moves away from the tip portion of the clamp element 1A, so as to open or close the clamp 1, i.e. so as to release or clamp the weft thread.

The first terminal end area 2C of the actuator 2 may be securely fixed relative to the free end 4C of the lever 4A and relative to the clamp element 7A in alternative arrangements, so that the clamp 1 is either open or closed respectively in a non-actuated resting state. Namely, in a first arrangement, the clamp element 1B is pressed against the clamp element 1A in the non-actuated state, and then the application of an actuation voltage via the wires 13 and 14 to the actuator 2 causes the clamp element 1B to be deflected away from the clamp element 1A to open the clamp. In a second alternative arrangement, the non-actuated clamp element 1B is located away from the fixed clamp element 1A, and the application of an actuation voltage to the actuator 2 causes the clamp element 1B to deflect into clamping engagement with the fixed clamp element 1A. In yet a third arrangement possibility, the non-actuated or resting clamp element 1B is in a neutral position, and the application of respective actuating voltages of opposite polarity will respectively deflect the clamp element 1B into an open position or a closed position relative to the fixed clamp element 1A.

FIG. 2 shows a second embodiment in which the actuator 2 is not directly embodied as a clamp element or a part thereof as described above, but rather a respective actuator 2 is mounted on the respective presenting lever 4A near the control shaft 4B of the weft thread presenting and clamping apparatus 4. The actuator 2 in this embodiment may be a piezoelectric actuator or any other type of actuator discussed herein. A motion transfer member 3 is arranged and operatively connected between the actuator 2 and the movable second clamp element 1B of the thread clamp 1. The motion transfer member 3 transmits the actuating or control motion of the actuator 2 to the second clamp element 1B to achieve an opening and closing of the thread clamp 1. The motion transfer member 3 may be any transmission element that transmits a push-pull motion, such as a push-pull cable in a flexible sheath, a rod linkage with hinge journals, a hydraulic or pneumatic line with piston devices at the ends thereof, etc. This push-pull motion is illustrated by the double-ended arrow 3A in FIG. 2.

The control unit 10 drives or applies actuating power to the actuator 2 via a signal line 10A, a contact strip 15, and a flexible cable 16. This arrangement allows for the pivoting or swinging motion of the weft thread presenting lever 4A about the pivot axis, without interference, from a home position 7 into an operating position 8 as shown by dashed lines, which motion is effected by means of the control shaft 4B.

Figure 3:
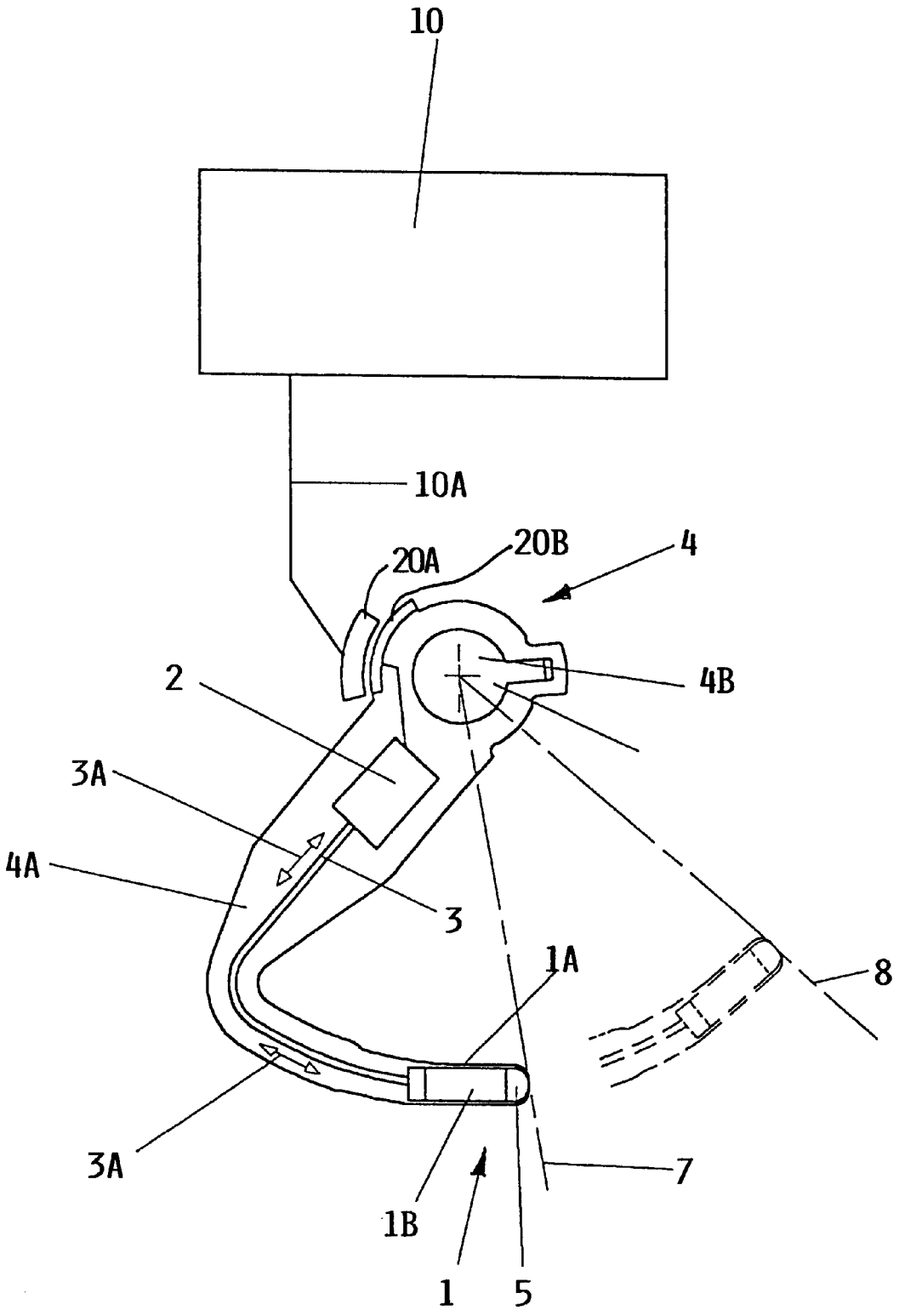
FIG. 3 is a schematic plan view of the weft thread presenting and clamping apparatus generally similar to that of FIG. 2, but with a non-contact signal transmission between the control unit and the actuator.

A further embodiment of the apparatus according to the present invention is shown in FIG. 3. This embodiment corresponds in its structure and operation to the embodiment shown in FIG. 2, except that the signal transmission from the control unit 10 to the actuator 2 is not achieved by direct contact via wires, but instead is effected by non-contact means, for example by induction through respective inductive transducers 20A and 20B.

Figure 4:
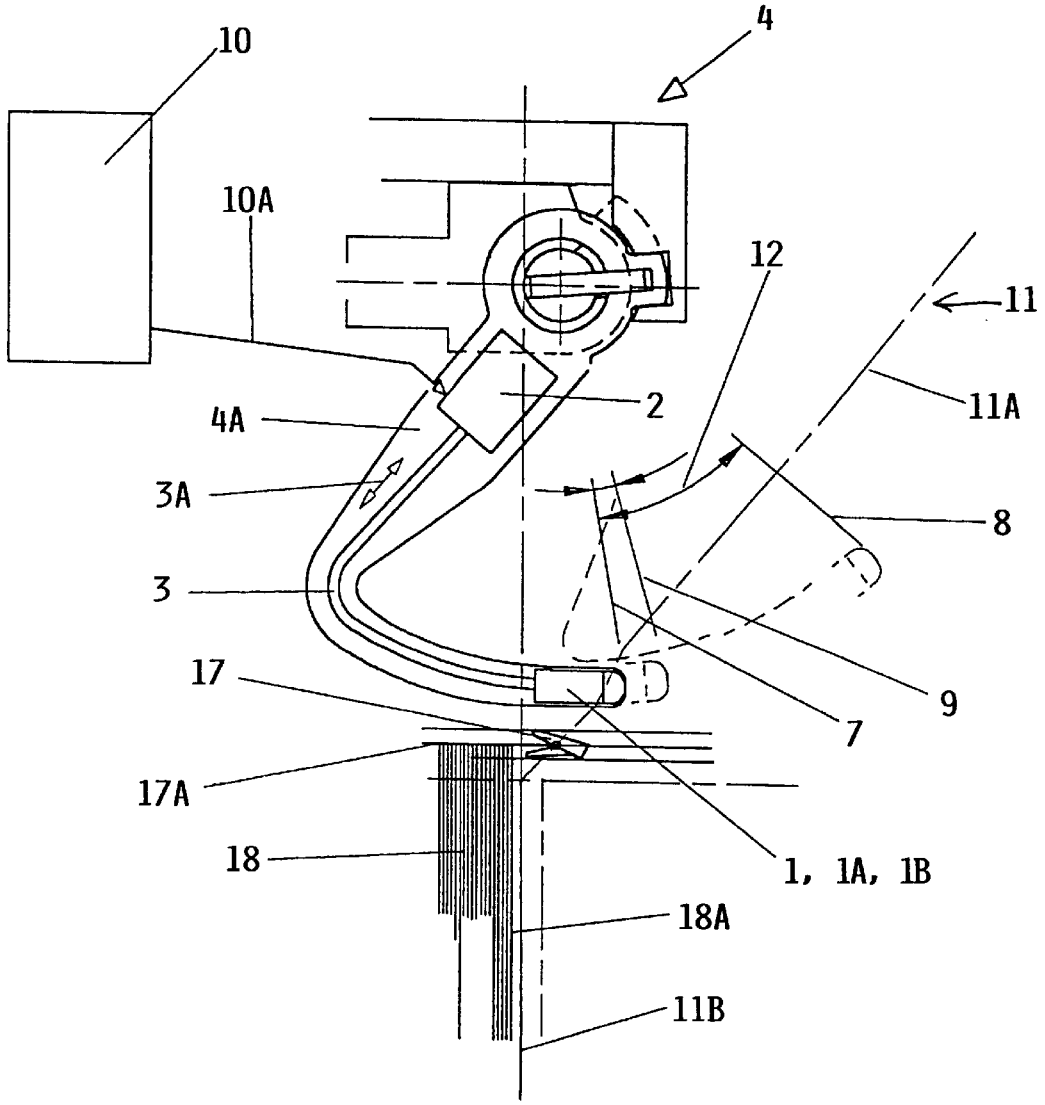
FIG. 4 is a schematic plan view showing the range of the pivot or swing angle of the presenting lever of the weft thread presenting and clamping apparatus according to FIGS. 2 and 3.

FIG. 4 shows a range of swing or angular rotation 12 of the weft thread lever 4A with the thread clamp 1 in a reference plane. The structure and the operation of the thread clamp 1 with the first and second clamp elements 1A, 1B, respectively, can be understood from the above description of FIGS. 2 and 3. Thus, FIG. 4 simply illustrates, and will be the basis for a description of, the various positions of the presenting lever 4A and particularly the thread clamp 1. These position are: a home position 7 relative to a cutting plane 17A of a weft thread cutter 17, an intermediate or clamping position 9 and a gripper or presenting position 8. In this context it is important that the positions 7, 8, and 9 are within the range of angular rotation 12 lying in the reference plane for each lever 4A with a respective thread clamp 1 of the apparatus 4.

The home position 7 is the non-presenting position of the thread clamp 1. The gripper or presenting position 8 is the position in which the weft thread 11 is presented to a gripper (not shown) of a gripper loom and then released from the clamp 1 and transferred to the gripper via a controlled opening of the thread clamp 1 as described above. In the intermediate position 9, the next weft thread portion 11A that is being held ready, yet is still connected to the prior weft thread portion 11B that has been inserted into a weaving shed and has been beat-up against the binding edge 18A of the woven web 18, is picked up and clamped in the thread clamp 1 by a controlled opening and closing of the thread clamp 1. The clamping or holding of the next ready weft thread portion 11A is maintained continuously until the beat-up weft thread portion 11B has been cut from the next ready weft thread portion 11A. Thereafter, the corresponding presenting lever 4A is moved back into the home position 7 still holding the weft thread 11 in the thread clamp 1. The weft thread 11 being held ready is positively clamped and held by the corresponding weft thread clamp 1 of the respective lever 4A until this particular thread 11 is to be presented and transferred to the gripper of a weft insertion rapier or tape in a subsequent weft insertion operation, in accordance with a control program stored in the control unit 10. At the appropriate time for transferring the thread to the gripper, the control program actuates the actuator 2 so as to positively open the clamp 1 and release the thread 11.

Figure 5:
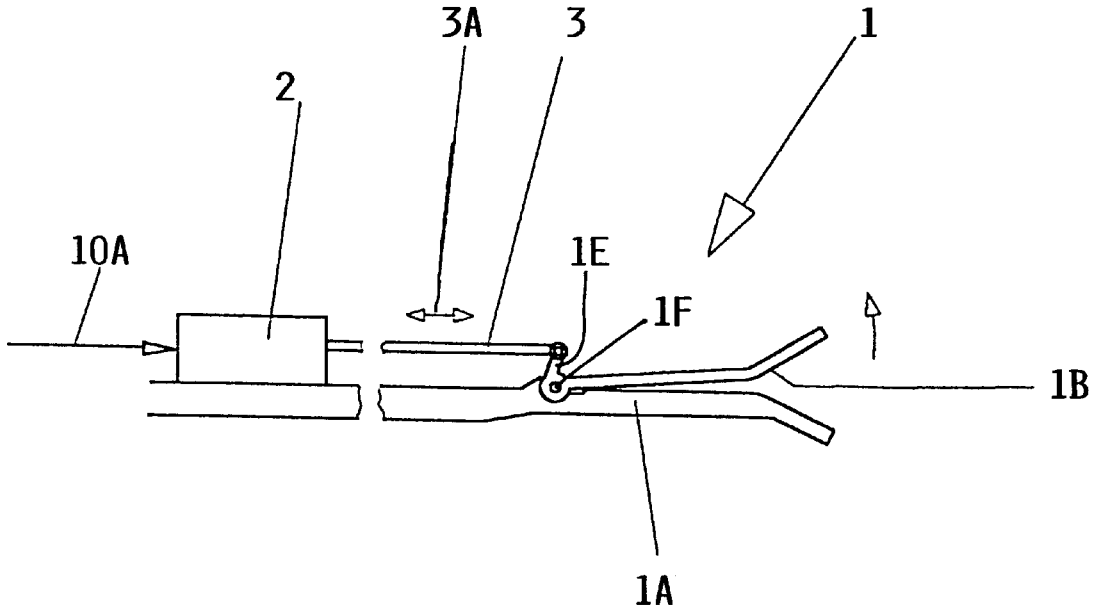
FIG. 5 is a schematic side view of the thread clamp shown in FIGS. 2 to 4, illustrating the transfer of the actuator motion to the movable clamp element by a lever-action mechanism.

FIG. 5 shows a further possibility for transferring and converting the push-pull motion of the actuator 2 to an opening and closing motion of the thread clamp 1 by means of a motion transfer member 3. In this embodiment the actuator 2 is, for example, an electromagnetic component such as a solenoid or the like. This actuator, similarly to the actuators of the above mentioned embodiments, is controlled by signals or energizing power provided by the control unit 10. The output motion of the actuator 2 is transferred as an opening and closing motion of the thread clamp 1 via the motion transfer member 3, which comprises a rod linkage connected to the movable clamp element 1B through a lever arm 1E which pivots with the clamp element 1B about a clamp hinge journal 1F relative to the fixed clamp element 1A. Each of these clamp elements may be a stiff metal plate or tongue, or may be somewhat flexible to allow an elastic yielding compensation when the clamp is tightly closed. Throughout this disclosure, reference to a "rigid" or "stiff" clamp element does not require absolute rigidity, but allows for slight elastic yielding, generally less than the extent that is typical in prior art thread clamps for weft presenting apparatus. Also, a description of the second clamp element being connected to the first clamp element refers to either a direct connection therebetween or an indirect connection therebetween, for example with both clamp elements connected respectively to the presenting lever.

Although the invention has been described with reference to specific example embodiments, it will be appreciated that it is intended to cover all modifications and equivalents within the scope of the appended claims. It should also be understood that the present disclosure includes all possible combinations of any individual features recited in any of the appended claims.

What is claimed is:

1. A weft thread clamping and presenting arrangement comprising a thread clamp including a first clamp element and a second clamp element that is connected to said first clamp element and that is deflectable relative to said first clamp element, wherein said second clamp element comprises a piezoelectric actuator that forms at least a part of said second clamp element and that is arranged and adapted to deflect said second clamp element relative to said first clamp element.

2. The weft thread clamping and presenting arrangement according to claim 1, further comprising a computerized control unit adapted to store and execute a control program, and a signal or power transmission path connecting said control unit to said actuator.

3. The weft thread clamping and presenting arrangement according to claim 2, wherein said transmission path comprises an electrical conductor establishing a permanent continuous electrical conduction path between said control unit and said actuator.

4. The weft thread clamping and presenting arrangement according to claim 2, wherein said transmission path comprises a non-contact signal transmission arrangement.

5. The weft thread clamping and presenting arrangement according to claim 4, wherein said non-contact signal transmission arrangement comprises two inductive signal transducers with a non-contact gap therebetween.

6. The weft thread clamping and presenting arrangement according to claim 1, further comprising a stop member that rigidly extends from said first clamp element and that is arranged to limit an opening movement of said second clamp element away from said first clamp element.

7. A weft thread clamping and presenting arrangement comprising:

a pivotable weft thread presenting lever having a pivotably supported end and a free end; and a thread clamp including a first clamp element and a second clamp element that is connected to said first clamp element and that is movable relative to said first clamp element;

wherein:

said second clamp element includes an actuator that forms at least a part of said second clamp element, and a wear resistant clamp tip body;

said first clamp element includes a first fixed end that is rigidly secured to said free end of said presenting lever;

said actuator includes a tip end, and opposite thereto a second fixed end that is rigidly secured to said free end of said presenting lever;

said wear resistant clamp tip body is arranged on said tip end of said actuator; and said actuator is arranged and adapted to move said second clamp element relative to said first clamp element.

8. The weft thread clamping and presenting arrangement according to claim 7, wherein said first fixed end of said first clamp element comprises a C-section partial sleeve member that securely grasps around and engages said free end of said presenting lever and said second fixed end of said actuator.

9. A weft thread clamping and presenting arrangement comprising:

a pivotable weft thread presenting lever having a pivotably supported end and a free end;

a thread clamp that is mounted on said free end of said pivotable weft thread presenting lever, and that includes a first clamp element and a second clamp element which is pivotably connected relative to said first clamp element by a pivot journal so as to be pivotably movable relative to said first clamp element;

an actuator that is arranged remotely from said second clamp element; and a motion transmission arrangement connecting said actuator to said second clamp element and adapted to transmit an actuating motion of said actuator to said second clamp element so as to pivot said second clamp element relative to said first clamp element about said pivot journal.

10. The weft thread clamping and presenting arrangement according to claim 9, wherein said actuator is a linear motion actuator, and said motion transmission arrangement comprises a rod linkage.

11. The weft thread clamping and presenting arrangement according to claim 9, wherein said actuator is a linear motion actuator, and said motion transmission arrangement comprises a flexible sheath and a push-pull cable arranged in said flexible sheath.

12. The weft thread clamping and presenting arrangement according to claim 9, wherein said actuator comprises a piezoelectric actuator.

13. The weft thread clamping and presenting arrangement according to claim 9, wherein said actuator comprises an electromagnetic actuator.

14. The weft thread clamping and presenting arrangement according to claim 9, wherein said actuator comprises a pneumatic-electric actuator.

15. The weft thread clamping and presenting arrangement according to claim 9, wherein said actuator comprises a hydraulic-electric actuator.

16. The weft thread clamping and presenting arrangement according to claim 9, wherein said actuator comprises an electric drive motor.

17. In a weft thread presenting and clamping apparatus for presenting a selected weft thread to a weft insertion gripper of a gripper loom, including a plurality of weft thread presenting levers arranged to be pivotable about a pivot axis and shiftable along said pivot axis to move a selected one of said levers into a thread presentation reference plane, a plurality of weft thread clamps that are respectively mounted on free ends of said presenting levers and that each respectively comprise first and second clamp elements adapted and arranged to clampingly hold a weft thread therebetween, and a computerized control unit that is adapted to store and execute a control program and thereby control a pivoting and shifting of said levers with respect to said pivot axis, an improvement wherein:

said second clamp element of each said respective thread clamp is deflectable relative to said first clamp element of said respective thread clamp, and comprises an incorporated actuator that forms at least a part of said second clamp element and that is arranged and adapted to deflect said second clamp element relative to said first clamp element.

18. In a weft thread presenting and clamping apparatus for presenting a selected weft thread to a weft insertion gripper of a gripper loom, including a plurality of weft thread presenting levers arranged to be pivotable about a pivot axis and shiftable along said pivot axis to move a selected one of said levers into a thread presentation reference plane, a plurality of weft thread clamps that are respectively mounted on free ends of said presenting levers and that each respectively comprise first and second clamp elements adapted and arranged to clampingly hold a weft thread therebetween, and a computerized control unit that is adapted to store and execute a control program and thereby control a pivoting and shifting of said levers with respect to said pivot axis, an improvement wherein:

said apparatus further comprises a respective remote actuator respectively arranged on each said respective presenting lever remotely from said second clamp element of said respective thread clamp mounted on said respective presenting lever, and a motion transmission arrangement that connects said remote actuator to said second clamp element and that is adapted to convey an actuating motion of said remote actuator to said second clamp element so as to move said second clamp element relative to said first clamp element.

* * * * *

UNITED STATES PATENT AND TRADEMARK OFFICE
CERTIFICATE OF CORRECTION

PATENT NO. : 6,119,733

DATED : September 19, 2000

INVENTOR(S) : Arndt et al.

It is certified that error appears in the above-identified patent and that said Letters Patent is hereby corrected as shown below:

On the Title Page: under [56], "FOREIGN PATENT DOCUMENTS",
line 2, after "5/1998", replace "European Pat. Off." by
--Germany--;

Col. 2, line 63, after "actuator" (2nd occurrence), insert --,--.

Signed and Sealed this

Twenty-fourth Day of April, 2001

*Attest:*

Nicholas P. Godici

NICHOLAS P. GODICI

*Attesting Officer*

*Acting Director of the United States Patent and Trademark Office*